United States Patent [19]

Kristiansen

[11] Patent Number: 4,898,273

[45] Date of Patent: Feb. 6, 1990

[54] PACKING FOR TRANSPORT OF PRODUCTS GIVING OFF MOISTURE

[75] Inventor: Cato Kristiansen, Rena, Norway

[73] Assignee: Renaco AS, Rena, Norway

[21] Appl. No.: 821,032

[22] Filed: Jan. 21, 1986

[30] Foreign Application Priority Data

Feb. 21, 1985 [NO] Norway ..... 850698

[51] Int. Cl.[4] ..... B65D 81/26

[52] U.S. Cl. ..... 206/204; 426/124; 426/129

[58] Field of Search ..... 206/204, 205, 508, 509; 229/3.5 R 4, 9, 138, 139; 312/31, 31.02, 31.1–31.3; 426/124, 129, 392

[56] References Cited

U.S. PATENT DOCUMENTS

| | | | |
|---|---|---|---|
| 2,204,784 | 6/1940 | Abrams | 312/31.2 |
| 2,596,763 | 5/1952 | Crowley | 312/31.3 |
| 3,026,209 | 3/1962 | Niblack et al. | 426/124 |
| 3,286,905 | 11/1966 | Farukhi | 229/9 |
| 3,495,507 | 2/1970 | Haas et al. | 229/3.1 |
| 3,586,201 | 6/1971 | Ebert | 206/509 |
| 3,756,681 | 9/1973 | Croston | 426/124 |
| 3,792,810 | 2/1974 | Tingley et al. | 229/138 |
| 3,801,001 | 4/1974 | Taylor | 229/139 |
| 3,853,260 | 12/1974 | WOod | 229/139 |
| 4,293,072 | 10/1981 | Hill et al. | 206/509 |

FOREIGN PATENT DOCUMENTS

| | | | |
|---|---|---|---|
| 0536161 | 1/1957 | Canada | 312/31.2 |

*Primary Examiner*—Jimmy G. Foster

*Attorney, Agent, or Firm*—Mason, Fenwick & Lawrence

[57] ABSTRACT

A packing container for transport of products giving off moisture, e.g. fresh iced fish products and fresh meat products, comprising a box that opens upwards and is made from a liquid tight material with a lid and a bottom having drainage openings. The bottom is raised in relation to the lower edges of the side walls of the box for forming a chamber that is open downwards where a moisture absorbent is placed. The chamber may be closed with a lid being identical with said upper lid. The lids are provided with annular grooves on both side faces for engagement with projections on the upper and lower edges of the box side walls. Furthermore, the annular grooves in the lower lids are intended for engagement with packing containers that are open upwards when the packing containers are piled on top of each other to prevent lateral sliding. To achieve additional safeguarding against seepage of moisture the packing container is placed in an outside packing made from watertight carboard in the shape of a sleeve with leakage proof end closures.

5 Claims, 2 Drawing Sheets

PACKING FOR TRANSPORT OF PRODUCTS GIVING OFF MOISTURE

The present invention relates to a packing container for transport of products giving off moisture, e.g. fresh iced fish products, and fresh meat products, of the kind stated in the preamble of the following independent claim 1.

Various approved designs of air freight packing container for products of the above mentioned kind are known and used. Especially in connection with air freight there are three different approved types. They are all based on an outside package of cardboard. The outside package is two-piece there being a bottom and a lid member. Said members must be stapled with three staples in each corner, which means totally 24 staples a unit. To day, this is done manually by the users.

The difference between various approaches is to be found in the design of the inside package component.

The different kinds are:

1. Bottom and lid members made of cardboard (outside package).

A two-piece polystyrene insert to be set upright.

A bottom plate of cardboard.

An absorbent.

When the carton bottom and lid members have been stapled the two-piece polystyrene insert is placed in the lower carton member in the shape of a frame alongside the carton walls. The absorbent is, then placed on the bottom of the lower carton member with an intermediate bottom on top. The latter serves to distribute the pressure from the product that is placed on top of it. Then, the lid is put on, and the entire unit is provided with tape holding it together. This approach was specially developed for air freight, where no moisture or excrete from the product—iced fish or fresh meat—should be able to seep out and pollute the surroundings.

2. A bottom and a lid member of cardboard (outside package).

A standard polystyrene box

A lid of pellucid plastic

An absorbent.

The bottom and lid members must be stapled as mentioned above. Then, the absorbent is placed on the bottom of the lower member, whereafter the polystyrene box with the product is placed in said lower member on top of the absorbent. The plastic lid is then secured on the polystyrene box by the aid of tape before the cardboard lid is put on said lower member, and the entire unit is secured with tape. This unit is not adapted for any special means of transport.

3. This approach, in principle, corresponds to the above design 2, but the plastic lid is here replaced by a polystyrene lid of 2 cm height. The carton, thus, has its height increased by 2 cm and said polystyrene lid provides for better insulation. This design, besides, results in a less efficient utilization of the available load volume of various means of transport.

In addition to the three above mentioned packings standard polystyrene boxes are also used as transport packings for products giving off moisture during transport by car, ship and rail.

To day, standard polystyrene boxes of the same kind as mentioned under 3 are commonly used for motor transport. No absorbent is used, resulting inmelted ice and bloodied water from said products to be drained off said polystyrene box and directly into the motor vehicle. Thus, said transport means is polluted and after each transport the vehicle must be thoroughly cleaned to avoid corrosion as well as for sanitary reasons.

It is an object of the present invention to provide a packing for the above purpose, where the absorbent and the product are placed in such a manner relative to each other that the above mentioned seepage of melted ice and bloodied water to the environment is prevented. This will have a most positive effect on transport hygiene, transport equipment, as well ad on the environment.

According to the present invention said object is achieved by the characterizing features appearing from the characterizing part of the following indipendent claim 1 and from the characterizing part of the following dependent claims.

An embodiment of the invention will be disclosed below with reference to the drawing, where FIG. 1 shows the packing according to the invention in elevation and with the different parts in a spaced relationship;

Figure 1:
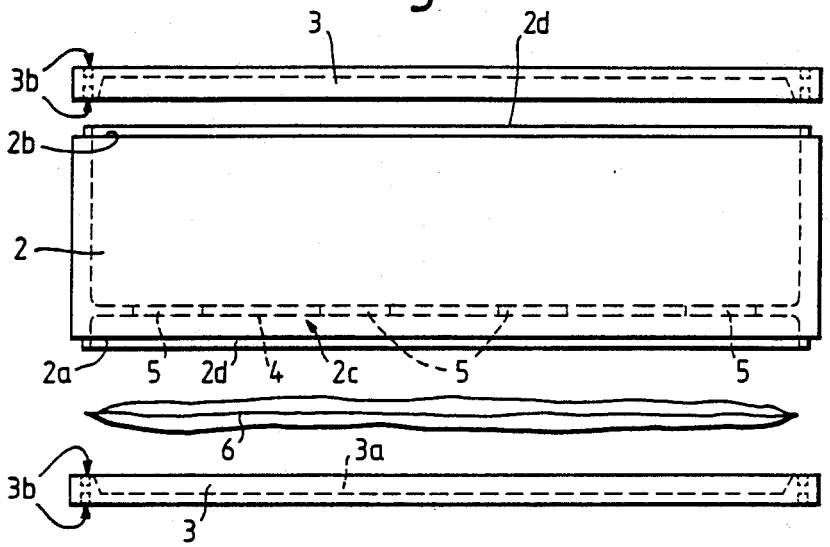
Figure 2:
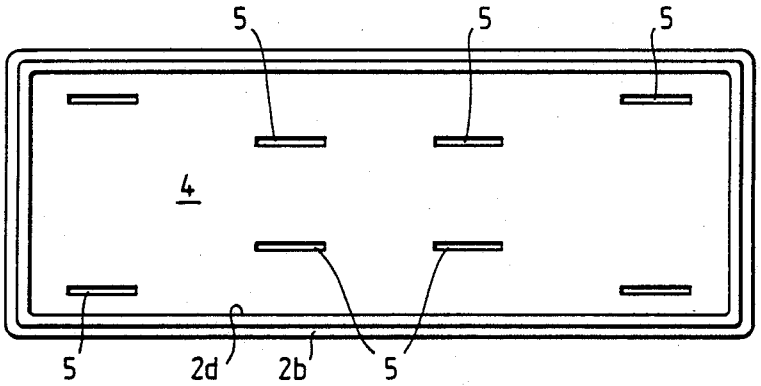
FIG. 2 shows a plan view of the carton member of the packing.
Figure 3:
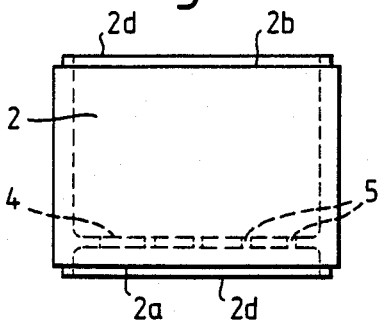
FIG. 3 shows the same in an end view.
Figure 4:
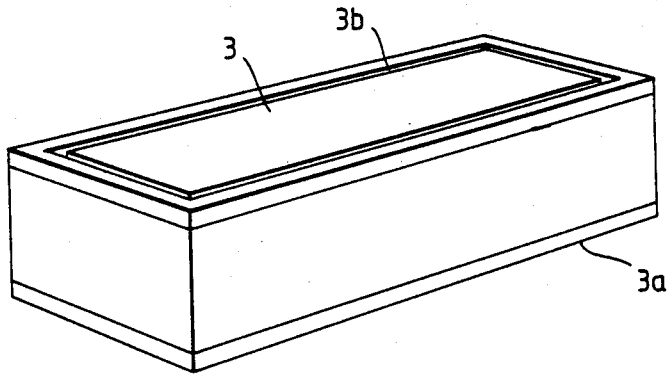
FIG. 4 shows the packing in perspective in an assembled state with the product inserted and ready for insertion in an outside packing, as shown in FIG. 5.
Figure 5:
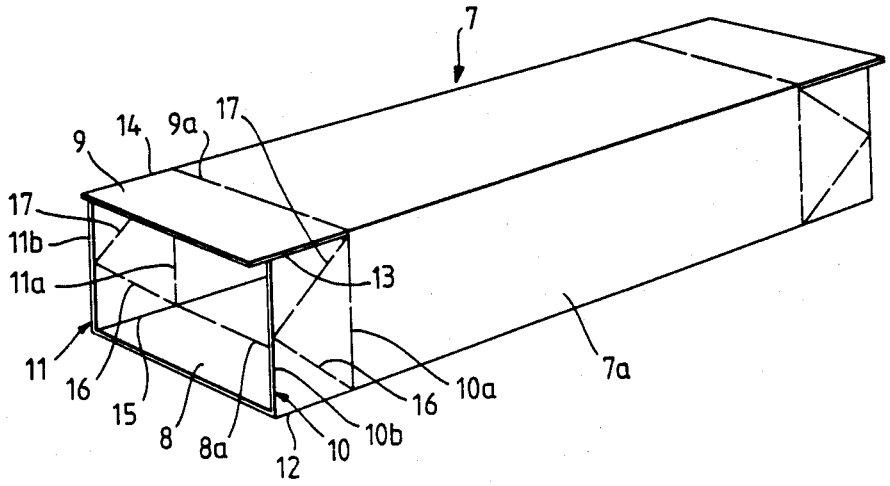

The packing component 1 for transport of products giving off moisture, e.g. fresh iced fish products and fresh meat products, as shown in the drawings, comprises a box or the like 2 that is open uppwards and is made from a liquid proof material, preferably from expanded polystyrene—EPS, polyurethane or some other foamed material. A lid 3 of the same material is provided for closing said box when the appropriate product has been placed in it.

Said box has a bottom 4 showing drainage openings 5. Said bottom 4 is elevated in relation to the lower edges 2*a* of the side walls of said box 2. In this manner a chamber 2*c* opening downwards for receiving a moisture absorbent 6 in the shape of a bag containing an absorbent is formed. Furthermore, the packing 1 comprises a lid 3*a* for closing said chamber 2*c* containing said absorbent 6.

In the practical embodiment said chamber lid 3*a* is identical to the upper lid 3 of the box 2 and made from the same material.

The identical lids 3 and 3*a* are provided with an annular groove 3*b* on one face for engagement with the upper andlower edges 2*a*, 2*b* of the side walls of the box being provided with annular projections 2*d* for engagement with the annular groove 3*b* of the lids 3, 3*a*. In the shown embodiment the lids 3, 3*a* are provided with equal annular grooves 3*b* in both faces. When packages containing product such as fish or meat products are transported it is, thus, possible to pile packages 1 that are open upwards, i.e. lack the upper lid 3, on top of each other, the upper edges 2*b* of the box walls with their annular projections engaging the annular grooves 3*b* on the lower lid 3*a* of the packing 1 piled on top. Thus, packings 1 that are open upwards may be piled on top of each other every packing unit being secured to the next lower packing unit. On the uppermost packing unit of the pile an upper lid 3 may be provided to cover the product inside said packing unit. In this manner a lower total height of the packing units 1 piled on top of each other is achieved as well as a secure pile.

When fresh iced products, fresh meat products or other products giving off moisture are transported in the above disclosed packages melted ice and cloodied water resp. will be drained from box 2 through the drainage openings 5 in its bottom 4 to chamber 2c with its moisture absorbent 6, provided below bottom 4, and the moisture will be absorbed and prevented from reaching the surroundings.

Said absorbent 6 may, e.g. be an approved absorbent marketed as "FIXOL", which according to prevailing requirements for air freight should be able to absorb 7.5 liters of blood and melt water.

When the above disclosed package is to be used in connection with air freight an outside package wherein said package 1 with its content of product is placed may be used as an additional safety measure to avoid seepage of liquid. The outside package 7 is made from a water-tight paper grade, e.g. provided with a polyethylene-PE-coating on both sides, and is shaped as a sleeve 7a having a square cross section corresponding to that of the package 1. Sleeve 7a is provided with end closures comprising foldable flaps 8, 9, 10, 11 with folding lines 8a, 9a, 10a, and 11a extending across the side walls of said sleeve. Adjacent lateral edges of said flaps are joined by folding lines 12, 13, 14, and 15. Two opposite flaps 10 and 11 are provided with inclined folding lines 16, 17 extending from the inside corners of said flaps at folding lines 10a and 11a to center portions at the outside edges 10b, 11b of flaps 10, 11, said inclined folding lines extending at 45° to the inside edges/folding lines 10a, 11a of said flaps 10,11. When said opposite flaps 10, 11 provided with inclined folding lines 16, 17 are folded inwards the other pair of opposite flaps 8, 9 will be folded towards each other as well and, thus, end closures are formed with a liquid tight connection between the side walls of sleeve 7a and the folded closing flaps. One flap 9 is, preferably, longer than the other flap 8 resulting in overlapping flaps in a folded down condition. By placing tape over the folded down flaps 8, 9, and possibly over a portion of the side walls of sleeve 7a a liquid tight outside package 7 for packing 1 is achieved.

Said outside package 7 may, thus, be delivered in a glued and plane state to the customers. It is, then, only raised for inserting package 1 and the flaps are folded and secured by the aid of tape.

In connection with the above mentioned piling of package 1 on top of each other, the upper lid on each package in said pile may be a pellucid plastic sheeting lid cooperating with the upper side wall projections 2d of the box 2 and not filling up so much in the width of projections 2d that the annual grooves 3b of the lower lid 3a of the package 1 on top cannot engage withsaid projections 2d.

As mentioned above, a polystyrene lid 3 is placed on the uppermost packing 1 securing the best possible insulation. Due to its structure and flexibility of usage said packing 1, possibly with an outside package 7, according to the invention can replace the existing packages for air freight as well as freight by car, boat, and rail. The package according to the present invention, thus, may replace all three different solutions discussed at the beginning and will result in a better utilization of the load volume in the means of transport used. The package is adapted to the measures, 80 x 120 cm, of the EUR-pallet, and it suits the measures, 120 x 160 cm, of the ship pallet. It is, also, adapted for air freight containers and air freight pallets.

The weight of a complete package is reduced as compared to known packages, and in connection with said better utilization of the load volume this will bring considerable savings of freight costs.

Due to the fact that the outside package in the shape of a cardboard sleeve 7 is delivered in a glued and plane shape and that packing 1/the inside package is considerably simplified costs in connection with raising and preparing the package means used for air freight packing will be reduced. This approach, also, permits automation of the packing process as well as the marking process which is stongly desired by breeders/exporters.

As a result of a considerable simplification of the complete package the inventor was able to reduce packing costs by approx. 30% as compared to the presently used solutions. According to calculations made this may result in savings of several millions of NOK annually.

Having described my invention, I claim:

1. A packing assembly for storage and transport of fresh food products which give off moisture, such as fresh iced fish product and fresh meat products and the like comprising a box opening upwards and made from a liquid tight material with an upper lid, side and end walls, and a double bottom comprising an upper bottom member with drainage openings and a lower bottom member, and a moisture absorbent provided in a chamber between said bottom members where said absorbent is kept in place and is protected against mechanical strain, the upper bottom member of the box being raised in relation to lower edges of the side and end walls of the box to form said chamber having its opening facing fownward for insertion of a moisture absorbent, and the lower bottom member consisting of a chamber lid for closing said chamber with its content of absorbent, and said chamber lid being identically shaped with the upper lid for the box, and said side and end walls having lower and upper rims, and said lids being provided with an annular groove at one end face for engagement with the lower and upper rims of the box side and end walls.

2. A packing assembly as claimed in claim 1, characterized in that said lower and upper rims are provided with an annular projection for engagement with the annular groove of the lids.

3. A packing assembly as claimed in claim 1, characterized in that said lids are provided with identical annular grooves in both side faces.

4. A packing assembly as claimed in claim 1 including an outside package therefore comprising a sleeve, e.g. made of water tight cardboard, and having a quadrangular cross section complementary to that of said box, said sleeve being provided with end closures comprising foldable opposite flaps with folding lines extending across side walls of the sleeve, the sleeve having adjacent lateral edges interconnected via inside edge folding lines, and the two opposite flaps being provided with inclined folding lines extending from inner corners at the inside edge folding lines to center portions of outside edges of said flaps, said inclined folding lines extending at 45° to the inside edge/folding lines of said flaps.

5. Outside packing as claimed in claim 4, characterized in that said inclined folding lines meet at the outside edges of said flaps and that the sleeve includes a second pair of flaps with one flap of the opposite flaps of the second pair of flaps being longer that the other flap for mutual overlapping in a folded down state.

* * * * *